United States Patent [19]

Lowe

[11] 4,329,824

[45] May 18, 1982

[54] SHEET METAL BEAM

[76] Inventor: Colin F. Lowe, 5518 Aspen, Houston, Tex. 77081

[21] Appl. No.: 104,286

[22] Filed: Dec. 17, 1979

[51] Int. Cl.[3] ..... E04B 1/18

[52] U.S. Cl. ..... 52/634; 52/732; 52/738

[58] Field of Search ..... 52/729, 732, 634, 738

[56] References Cited

U.S. PATENT DOCUMENTS

| | | | |
|---|---|---|---|
| 854,391 | 5/1907 | Voshardt . | |
| 991,603 | 5/1911 | Brooks | 52/729 X |
| 1,351,615 | 8/1920 | Brown et al. . | |
| 1,360,720 | 11/1920 | Brown et al. . | |
| 1,457,303 | 6/1923 | Higgins . | |
| 1,997,876 | 4/1935 | Sheldon . | |
| 2,065,378 | 12/1936 | Kling . | |
| 2,871,997 | 2/1959 | Simpson et al. . | |
| 3,332,197 | 7/1967 | Hinkle | 52/731 |
| 3,342,007 | 9/1967 | Merson | 52/729 |
| 3,349,535 | 10/1967 | Balinski | 52/634 |
| 3,444,664 | 5/1969 | Fink, Jr. et al. | 52/732 |
| 4,109,440 | 8/1978 | Bill | 52/721 |
| 4,117,641 | 10/1978 | Wells | 52/404 |

FOREIGN PATENT DOCUMENTS

| | | | |
|---|---|---|---|
| 2524526 | 1/1976 | Fed. Rep. of Germany | 52/729 |
| 678165 | 8/1979 | U.S.S.R. | 52/729 |

*Primary Examiner*—Carl D. Friedman
*Attorney, Agent, or Firm*—Jacox & Meckstroth

[57] ABSTRACT

A panel of thin sheet metal is roll-formed into a beam having upper and lower first flange portions integrally connected by a web portion, and the first flange portions are reinforced by corresponding second flange portions which may be formed from the panel and folded back onto the corresponding first flange portion. The upper and lower flange portions project in opposite directions from the web portion providing the beam with a Z-shaped cross-sectional configuration to facilitate close nesting of the beams in a stack. A plurality of parallel spaced stiffening ribs are formed in the web portion, and longitudinally extending stiffening ribs are formed in the flange portions. When the ribs in the web portion extend longitudinally of the beam, a series of longitudinally spaced strut members extend transversely between the flange portions across the ribs and are attached to the flange and web portions. The strut members may extend through corresponding sets of aligned holes within the ribs, or the ribs in the web portion may extend transversely between the flange portions. The second flange portions may also be formed by separate heavier sheet metal strips which are attached to the first flange portions and the web portion.

23 Claims, 13 Drawing Figures

SHEET METAL BEAM

BACKGROUND OF THE INVENTION

In the construction of a metal building, it is common to use a frame which supports parallel spaced steel beams or purlins to which corrugated sheet metal roof panels are attached. The purlins have a Z-shaped cross-sectional configuration, for example, as illustrated in U.S. Pat. Nos. 2,871,997, 3,290,845, 3,982,373 and 3,513,614. Similar Z-shaped beams are attached to the sides of the frames and are commonly referred to as wall girts for supporting the roll-formed sheet metal side wall panels. The most commonly used purlins are roll-formed from a relatively heavy gauge steel strip, such as fourteen gauge (0.074"), and have a height of approximately eight inches. Thus the flange portions of a purlin are integrally connected by the flat web portion, and all of the portions have a common uniform thickness which results in a weight of approximately 3.67 pounds per linear foot for an eight inch purlin.

While eight inch purlins are most commonly used because of its strength/weight ratio, purlins having a greater height, such as twelve inches, are also used in view of the fact that the strength of the purlin increases as the square of the height. However, as the flat web portion of a conventional purlin increases to provide the purlin with a greater height, the additional thickness of steel needed in the web portion adds little to the increased strength but substantially increases the weight of the purlin.

It has also been found desirable for the flange portions of a purlin to have a substantially flat outer surface to provide proper attachment of the purlins to the metal frame and of the roof panels to the purlins by suitable fasteners. While a one-piece conventional Z-shaped purlin may be efficiently manufactured by roll-forming, it does not provide maximum utilization of the strength of the steel and thus does not obtain the maximum strength/weight ratio. While there have been many other types of sheet metal beams either proposed or made, none of these beams have been found satisfactory for replacing the above described purlins commonly used in the construction of a metal building.

SUMMARY OF THE INVENTION

The present invention is directed to an improved sheet metal beam which obtains maximum utilization of the strength of the sheet metal in order to minimize the thickness or gauge of the sheet metal and to obtain a maximum strength/weight ratio. While the beam of the invention is ideally suited for use as a purlin in the construction of a metal building, the beam of the invention may also be used in the construction of other building structures and may also be used as a vertical column.

A beam constructed in accordance with the invention is also adapted to be efficiently manufactured at a significantly lower cost than the cost of manufacturing conventional metal beams or purlins, and further provides a significantly lower weight per linear foot of beam so that the cost of handling and transporting the beam is significantly reduced. While a number of desirable features and advantages of a beam constructed in accordance with the invention are apparent from the drawings, other features and advantages of the invention will be apparent from the following description and claims in reference to the drawings.

DESCRIPTION OF THE PREFERRED EMBODIMENTS

Figure 1:
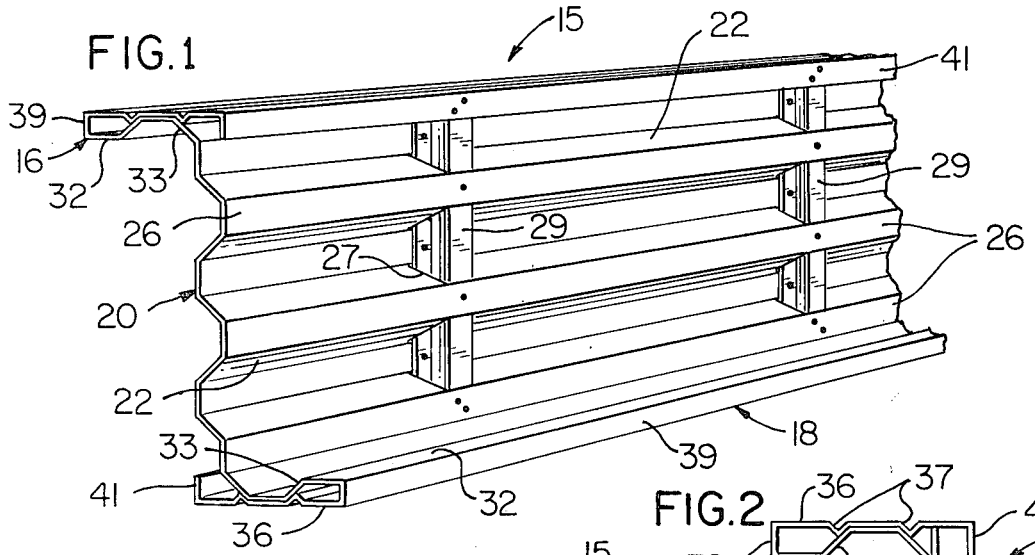
FIG. 1 is a perspective view of an end portion of a Z-shaped purlin or beam constructed in accordance with the invention.
Figure 2:
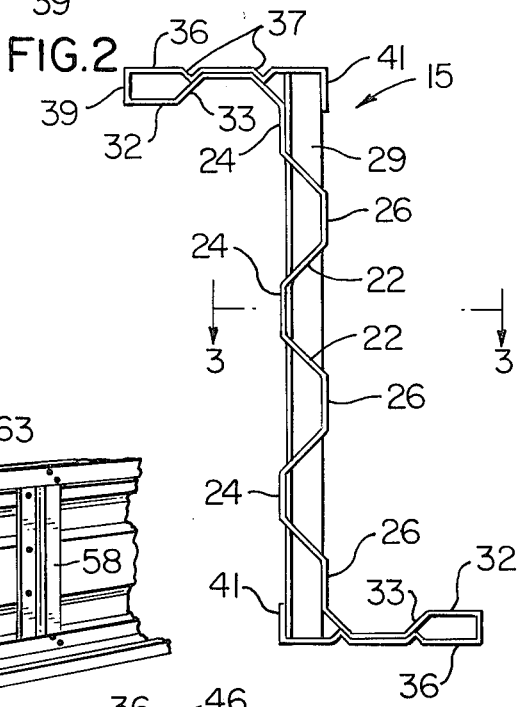
FIG. 2 is an end view of the beam shown in FIG. 1.
Figure 3:
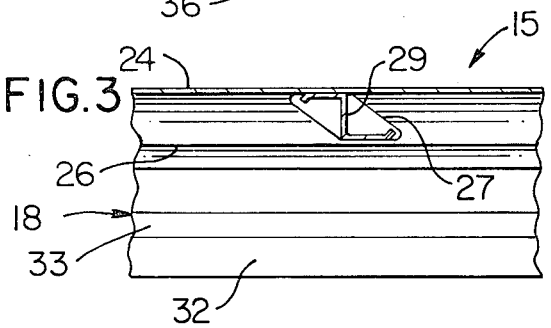
FIG. 3 is a fragmentary section taken generally on the line 3—3 of FIG. 2.

The sheet metal beam or purlin illustrated in FIG. 1–3 is constructed of a relatively thin gauge sheet metal such as 24 gauge steel which is 0.024 inch in thickness. The beam 15 includes an upper flange 16 and a lower flange 18 which are integrally connected by a web portion 20. The flanges 16 and 18 project in opposite directions from the web portion 20 to provide the beam with a Z-shape cross-sectional configuration so that a number of the beams may be stacked in a close-fitted nested relation for shipping and storage purposes. The web portion 20 is roll-formed with a corrugated cross-sectional configuration to form a plurality of longitudinally extending ribs 22 which project from flat coplanar base wall portions 24. Each of the ribs 22 has a trapezoid cross-sectional configuration, and the outer flat wall portions 26 of the ribs 22 are substantially the same size as the base wall portions 24. Sets of parallelogram shaped holes 27 (FIG. 3) are formed within the ribs 22 at longitudinally spaced intervals along the beam 15, and a formed sheet metal strut 29 extends through each set of aligned holes 27. Each strut 29 corresponds in length to the height of the web portion 20 and has a Z-shaped configuration so that the flanges of the strut 29 may be conveniently spot-welded or otherwise fastened to both the outer flat walls 26 of the ribs 22 and the flat base wall portions 24, as illustrated in FIG. 2.

Each of the flanges 16 and 18 of the beam 15 are formed of integral sections of the sheet metal panel and include a first or inner flange portion 32 having a rib 33 of trapezoid cross-sectional configuration. The panel section is folded back upon itself to form a second or outer flange portion 36 which has a pair of longitudinally extending V-shaped ribs 37 for receiving the rib 33 on the inner wall portion 32. Preferably, the inner flange portion 32 and outer flange portion 36 are secured together by longitudinally spaced spot-welds located at the top of the rib 33. The flange portions 32 and 36 are thus integrally connected by an outer edge wall portion 39 which cooperates to provide the flange with a tubular or hollow outer edge portion. The outer flange portion 36 of each flange extends to form a right angle lip portion 41 which projects inwardly and is secured by spot-welds to the adjacent flange of each strut 29.

The struts 29 may be inserted into the corresponding sets of openings or holes 27 within the ribs 22 while the sheet metal panel is being roll-formed and before one of the outer flange portions 36 is folded back into engagement with its adjacent inner flange portion 32. After the struts 29 are inserted, the spot welding of the flat wall portions and lip portions 41 to the struts is progressively performed as another operation.

The construction of the beam 15 provides a substantially high strength/weight ratio as a result of the configuration of the flanges 16 and 18 and the integration of the struts 29 with the stiffening ribs 22. The ribs 33 within each of the flange portions 32 of the beam also cooperate with the lip portions 41 to form a rigid and braced connection of each flange to the web portion. The integration of the ribs 22 and struts 29 also minimizes the overall thickness of the web portion 20 thereby providing for closer nesting of the beams when arranged in stacked relation. The beam 15 may also be conveniently constructed entirely of light gauge sheet metal which has a galvanized or other protective coating to provide an outer surface more durable than paint.

Figure 4:
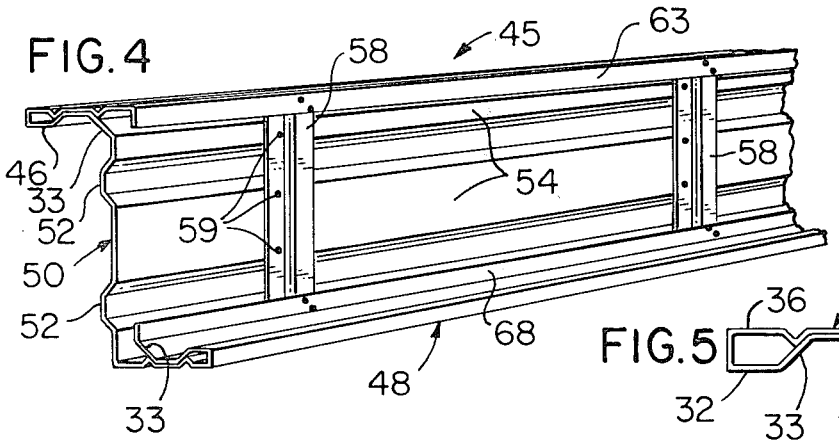
FIG. 4 is a perspective view similar to FIG. 1 and showing another embodiment of a beam constructed in accordance with the invention.
Figure 5:
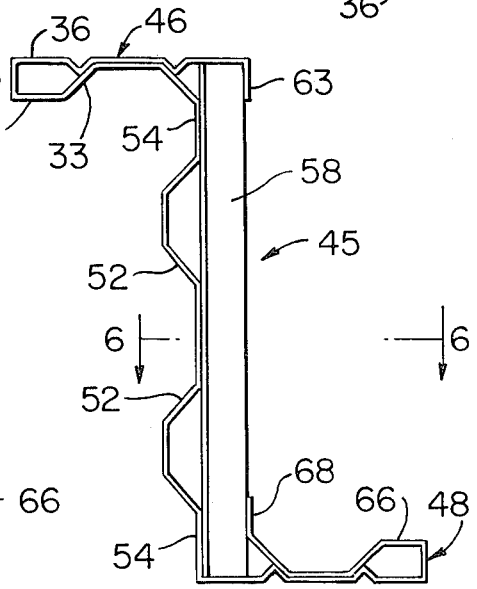
FIG. 5 is an end view of the beam shown in FIG. 4.
Figure 6:
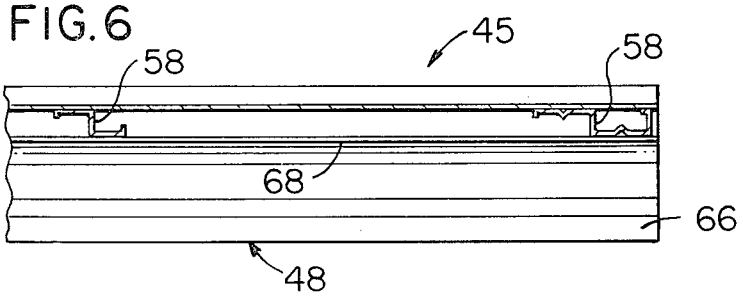
FIG. 6 is a fragmentary section taken generally on the line 6—6 of FIG. 5.

Referring to FIGS. 4–6 which illustrates another embodiment of a beam constructed in accordance with the invention, a beam 45 is roll-formed from a light gauge sheet metal, such as 24 gauge steel, and includes upper and lower flanges 46 and 48 which are integrally connected by a web portion 50 in a manner similar to the beam described above in reference to FIGS. 1–3. In the embodiment of FIGS. 4–6, the web portion 50 has two longitudinally extending ribs 52 which project from coplanar flat base wall portions 54, and a series of longitudinally spaced sheet metal struts 58 are positioned adjacent the base wall portions 54. The struts 58 are secured to the base wall portions 54 by fasteners or spot welds 59.

The upper flange 46 of the beam 45 is constructed substantially the same as the upper flange of the beam 15 and thus is identified with the same reference numbers. The flange has a corresponding lip portion 63 which projects downwardly or inwardly and is spot-welded to the struts 58. The lower flange 48 is also constructed similarly to the lower flange 18, except that the inner or second flange portion 66 has a lip portion 68 which is coplanar with the lip portion 63 and is also secured by spot welds to the struts 58. As shown in FIG. 6, in some beams it may be desirable for the strut member 58 located at the ends of the beam to be of a heavier sheet metal construction than the intermediate strut members 58 in order to carry the higher shear loads at the end portions of the beam. While the strength/weight ratio of the beam illustrated in FIGS. 4–6 is approximately that of the beam shown in FIGS. 1–3, the use of struts outside the web substantially lessens the nesting effectiveness. On the other hand, the beam 45 requires a somewhat lesser investment in tooling for manufacturing the beam.

Figure 7:
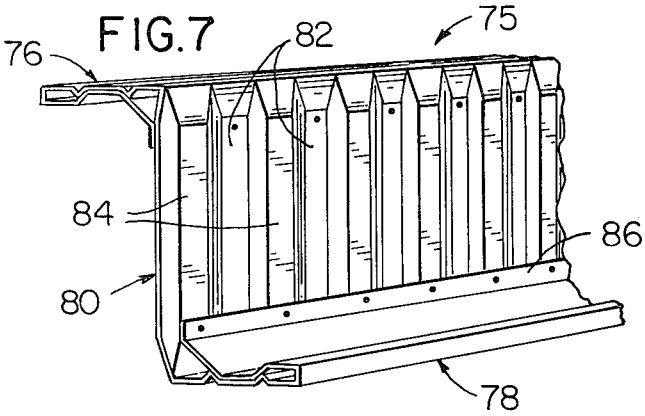
FIG. 7 is another perspective view similar to FIGS. 1 and 4 and showing another embodiment of a beam constructed in accordance with the invention.
Figure 8:
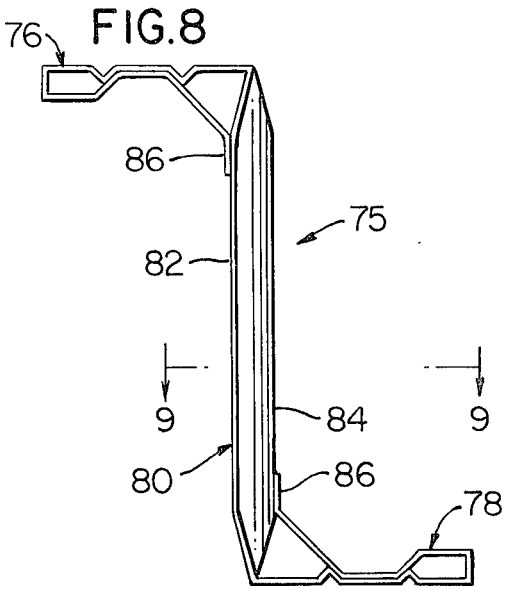
FIG. 8 is an end view of the beam shown in FIG. 7.
Figure 9:
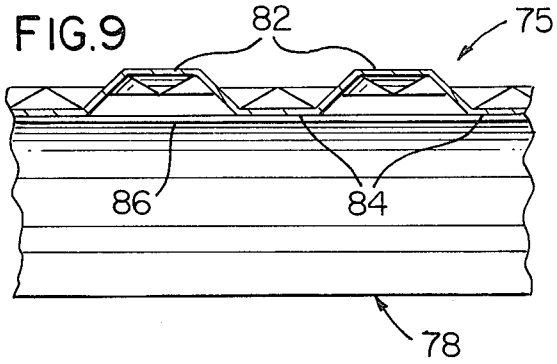
FIG. 9 is a fragmentary section taken generally on the line 9—9 of FIG. 8.

FIGS. 7–9 illustrates another embodiment of a purlin or beam 75 constructed in accordance with the invention and which is also adapted to be roll-formed from a light gauge sheet metal such as 24 gauge steel. The beam 75 includes an upper flange 76 and a lower flange 78 which are integrally connected by a web portion 80. The flanges 76 and 78 are roll formed to a configuration similar to the lower flange 48 of the beam 45 discussed above in connection with FIGS. 4–6, and thus required no further detail description. However, the web portion 80 of the beam 75 is impressed or formed with a series of longitudinally spaced and vertically extending ribs 82 each of which has a trapezoid cross-sectional configuration and projects from adjacent flat coplanar wall portions 84. The longitudinal spacing of the ribs 82 is preferably selected so that the web portion 80 of the beam 75 has uniform corrugations each formed by flat wall sections.

The inwardly projecting lip portions 86 of the flanges 76 and 78 are secured by spot welds to the outer flat wall sections of the ribs 82 and the flat wall sections 84 to provide the beam 75 with substantial rigidity and a high strength/weight ratio. While the beam 75 provides the desirable advantage of close nesting of adjacent beams in a stack, similar to the beam 15 disclosed above in FIGS. 1–3, the beam 75 requires separate progressive die tooling for forming the transverse ribs 82 which are formed in the sheet metal panel while it is generally flat and before roll-forming to produce the flanges 76 and 78.

Figure 10:
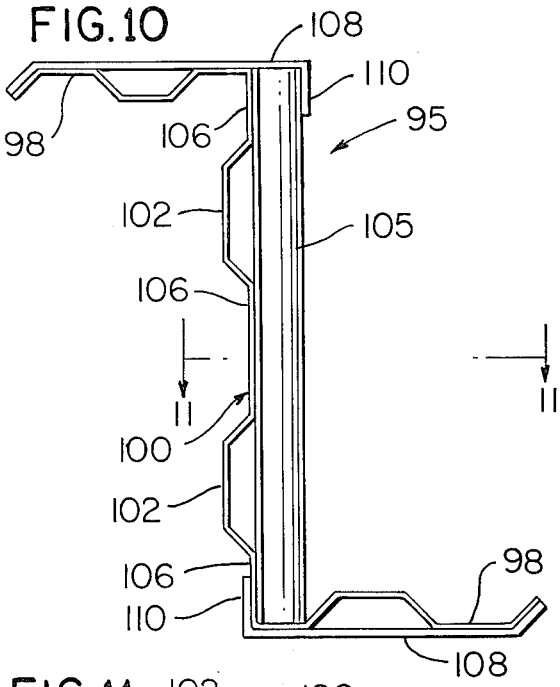
FIG. 10 is an end view of a beam constructed in accordance with a further embodiment of the invention.
Figure 11:
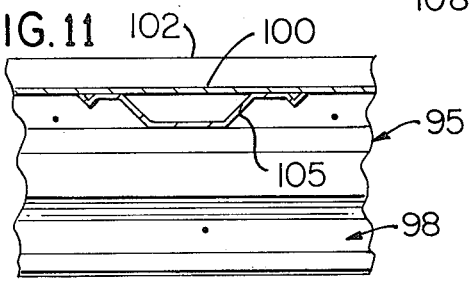
FIG. 11 is a fragmentary section taken generally on the line 11—11 of FIG. 10.

Referring to FIGS. 10 and 11, another sheet metal purlin or beam 95 is constructed in accordance with the invention and is roll-formed from a light gauge sheet metal panel to form flange portions 98 integrally connected by a web portion 100. The panel has a series of longitudinally extending ribs 102, with three of the ribs projecting from one side of the sheet metal panel and a fourth rib projecting from the opposite side of the panel. The roll-formed panel is then bent along two parallel longitudinal lines to form the flange portions 98 and the integrally connecting web portion 100. Thus each of the flange portions 98 is provided with one of the ribs 102, and the web portion 100 is provided with two of the ribs 102 each of which has a trapezoid cross-sectional configuration.

A series of longitudinally spaced and transversely extending struts 105 (FIG. 11) are spot-welded or riveted to the coplanar flat wall sections 106 of the web portion 100, and a formed sheet metal second flange portion or cap member 108 is attached by spot welds or other fasteners to each of the first flange portions 98 of the beam 95 to reinforce and stiffen the flange portion. As illustrated, each of the cap members 108 may be formed of a heavier gauge sheet metal and includes an inwardly projecting lip portion 110. The lip portion 110 of the upper cap member 108 is attached by spot welds to the outer flat wall sections of the struts 105, and the lip portion 110 of the lower cap member 108 is attached by spot welds to the lower flat wall section 106 of the web portion 100.

The purlin or beam 95 illustrated in FIGS. 10 and 11 is adapted to be manufactured with a lower tooling investment and a higher labor cost than required for producing the beams described above in references to FIGS. 1–9. Thus the beam 95 is ideally suited for smaller volume production. In addition, the web portion 100 of the beam 95 may be more easily changed so that the beam may be produced according to the specific use of the beam.

Figure 12:
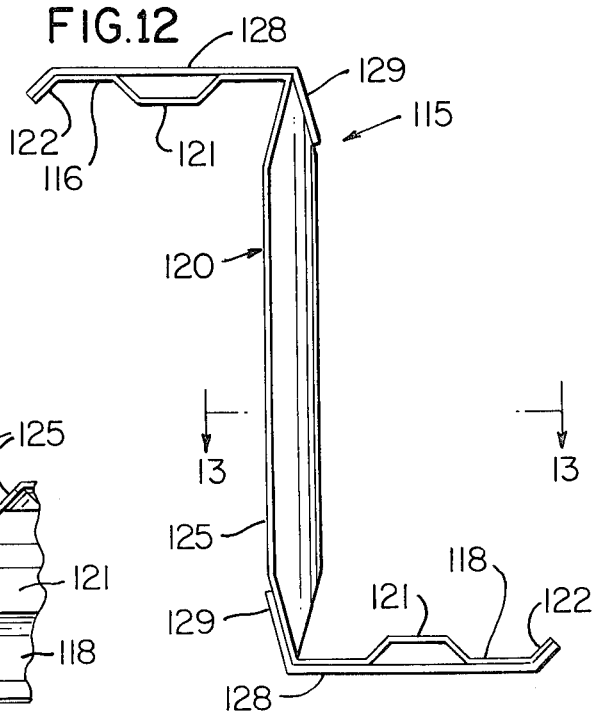
FIG. 12 is an end view, similar to FIG. 10, of a beam constructed in accordance with still another embodiment of the invention.
Figure 13:
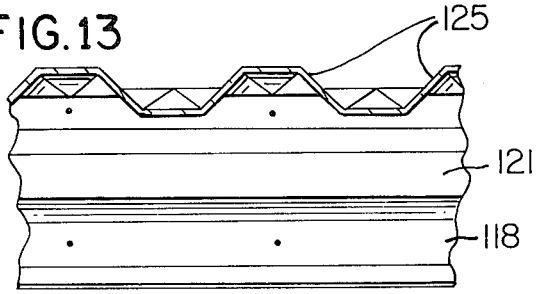
FIG. 13 is a fragmentary section taken generally on the line 13—13 of FIG. 12.

Another Z-shaped purlin or beam 115 constructed in accordance with the invention, is illustrated in FIGS. 12 and 13. In this embodiment, the beam 115 is formed of a thin gauge sheet metal panel in the same manner as the beam 75 to provide an upper flange portion 116 and a lower flange portion 118 integrally connected by a web portion 120. The flange portions 116 and 118 are roll-formed in a manner similar to the corresponding flange portions of the beam 95, and each flange portion includes a longitudinally extending stiffening rib 121 and an inclined edge portion 122. The web portion 120 of the beam 115 is formed in the same manner as the web portion 80 of the beam 75, that is, with longitudinally spaced and transversely or vertically extending ribs 125 each defined by flat wall sections forming a trapezoid cross-sectional configuration. Each of the flange portions 116 and 118 of the beam 115 is further reinforced by a second flange portion or cap member 128 which is preferably formed of a heavier gauge sheet metal and is attached by spot welds or rivets to the corresponding first or inner flange portion. Each of the cap members 128 also includes an inwardly projecting lip portion 129 which is spot welded or otherwise fastened to the web portion 120 to form a rigid second connection between the flange portions and the web portion 120.

From the drawings and the above description, it is apparent that a sheet metal beam constructed in accordance with the present invention provides desirable features and advantages. For example, each of the beam constructions is primarily formed of a relatively light gauge sheet metal panel having a thickness less than 0.040 inch and preferably about 0.024 inch. The sheet metal panel is formed in a manner which provides for utilizing the inherent strength of the sheet metal and to obtain a maximum strength/weight ratio. As a result, a beam constructed in accordance with the invention significantly reduces the cost for constructing a beam having a predetermined strength and thus makes more efficient use of the metal. The substantially higher strength/weight ratio of the beam also results in significantly reducing the weight of each linear foot of the beam from the weight of a conventional beam, for example, from 3.67 #/ft. to 2.125 #/ft. for an 8 inch beam, or 2.25 #/ft. for a 9½" beam of equivalent strength, so that the beam of the invention may be more easily handled and more economically shipped than conventional beams.

A beam constructed in accordance with the invention also provides for flexibility in design in that the height of the web portion of the beam may be selected or increased without substantially increasing the weight of the beam, thereby taking advantage of the fact that the strength of the beam increases as the square of the web height. Each of the beam embodiments also provides flange portions having large flat outer surfaces which are highly desirable for attaching the beams to a frame and for attaching overlying corrugated sheet metal panels to the beams with threaded fasteners.

While the forms of beams herein described constitute preferred embodiments of the invention, it is to be understood that the invention is not limited to these precise forms of beams, and that changes may be made therein without departing from the scope and spirit of the invention, as defined in the appended claims.

The invention having been described, the following is claimed:

1. An improved elongated beam adapted for use in constructing a metal building and having a substantially high strength/weight ratio, said beam comprising a sheet metal panel being bent to form upper and lower first flange portions integrally connected by a web portion disposed generally perpendicular to said flange portions, said web portion of said panel having a plurality of parallel spaced and longitudinally extending integrally formed stiffening ribs, upper and lower sheet metal second flange portions disposed adjacent the corresponding said upper and lower first flange portions, a plurality of longitudinally spaced strut members extending between said upper and lower flange portions, means rigidly connecting said strut members to said web portion and said second flange portions, and at least one of said upper flange portions and at least one of said lower flange portions having a longitudinally extending and integrally formed stiffening portion.

2. A beam as defined in claim 1 including means defining longitudinally spaced sets of aligned holes within said ribs in said web portion of said panel, and each said strut member extends through a set of aligned holes.

3. An improved elongated beam adapted for use in constructing a metal building and having a substantially high strength/weight ratio, said beam comprising a sheet metal panel forming an upper first flange portion integrally connected to a lower first flange portion by a web portion disposed generally perpendicular to said flange portions, said web portion having a plurality of vertically spaced and longitudinally extending stiffening ribs projecting laterally from upper, lower and intermediate web sections to provide said web portion with a generally corrugated vertical cross-sectional configuration, a plurality of longitudinally spaced strut members extending generally vertically between said upper and lower flange portions, upper and lower sheet metal second flange portions disposed adjacent corresponding said upper and lower first flange portions, means rigidly securing said strut members to said upper and lower second flange portions, and vertically spaced means rigidly securing said strut members to said upper, lower and intermediate web sections for positively maintaining said corrugated vertical cross-sectional configuration of said web portion.

4. A beam as defined in claim 3 or 1 wherein each of said second flange portions is integrally connected to the corresponding first flange portion by an outer edge wall portion.

5. A beam as defined in claim 4 wherein each of said outer edge wall portions cooperates with the corresponding first and second flange portions to form a tubular outer edge portion.

6. A beam as defined in claim 3 wherein each of said ribs in said web portion has a generally trapezoid cross-sectional configuration.

7. A beam as defined in claim 3 wherein the depth of said strut members is substantially the same as the depth of said ribs within said web portion.

8. A beam as defined in claim 1 wherein each said second flange portion includes an inwardly projecting lip portion, and at least one of said lip portions being rigidly attached to said strut members.

9. A beam as defined in claim 3 or 1 wherein each of said strut members has a generally Z-shaped cross-sectional configuration to facilitate attaching said strut member to said flange and web portions of said panel.

10. A beam as defined in claim 3 wherein each said rib in said web portion has a trapezoid cross-sectional configuration.

11. A beam as defined in claim 3 or 1 wherein said second flange portions are separate from said panel and comprise sheet metal strips having a thickness greater than the thickness of said panel.

12. A beam as defined in claim 3 wherein one of said upper flange portions and one of said lower flange portions each includes an inclined brace portion attached to said web portion.

13. A beam as defined in claim 3 wherein said sheet metal panel has a thickness of about 0.024 inch.

14. A beam as defined in claim 3 including means defining longitudinally spaced sets of aligned holes within said ribs in said web portion of said panel, and each said strut member extends through a set of aligned holes.

15. A beam as defined in claim 3 or 1 wherein each said second flange portion includes an inwardly projecting lip portion, and at least one of said lip portions being rigidly attached to said strut members.

16. An improved elongated beam adapted for use in constructing a metal building and having a substantially high strength/weight ratio, said beam comprising an upper first flange portion rigidly connected to a lower first flange portion by a web portion disposed generally perpendicular to said flange portions, said web portion comprising a sheet metal panel having a plurality of parallel spaced and longitudinally extending integrally formed stiffening ribs, means defining longitudinally spaced sets of aligned holes within said ribs in said web portion of said panel, a plurality of longitudinally spaced strut members extending between said upper and lower flange portions, each said strut member extending through a set of aligned holes, and means rigidly connecting said strut members to said flange portions and to said web portion between said ribs.

17. An improved elongated beam adapted for use in constructing a metal building and having a substantially high strength/weight ratio, said beam comprising a sheet metal panel having a thickness less than 0.040 inch, said panel being bent to form upper and lower first flange portions integrally connected by a web portion disposed generally perpendicular to said first flange portions, said first flange portions projecting in opposite directions from said web portion and providing said beam with a generally Z-shaped cross-sectional configuration to facilitate stacking a plurality of said beams in overlying nested relation, said web portion of said panel having a plurality of parallel spaced and longitudinally extending integrally formed stiffening ribs, means defining longitudinally spaced sets of aligned holes within said ribs in said web portion, upper and lower sheet metal second flange portions disposed adjacent the corresponding said upper and lower first flange portions, one of said upper flange portions partially overlapping one of said lower flange portions, means independent of said first flange portions for rigidly connecting each of said second flange portions to said web portion, said independent means including a plurality of longitudinally spaced strut members extending generally perpendicular to said upper and lower flange portions, each said strut member extending through a set of aligned holes within said ribs and rigidly connected to said flange and web portions, and at least one of said upper flange portions and at least one of said lower flange portions having a longitudinally extending and integrally formed stiffening rib.

18. A beam as defined in claim 17 wherein said ribs in said flange portions each has a generally trapezoid cross-sectional configuration.

19. A beam as defined in claim 17 wherein said ribs within said web portion project away from said strut members, and means rigidly securing said strut members to one of said first flange portions and one of said second flange portions.

20. A beam as defined in claim 17 wherein said second flange portions are integral portions of said panel nd project from corresponding said first flange portions.

21. A beam as defined in claim 17 wherein said second flange portions are separate from said panel and comprise sheet metal strips having a thickness greater than the thickness of said panel.

22. An improved elongated beam adapted for use in constructing a metal building and having a substantially high strength/weight ratio, said beam comprising a sheet metal panel having a thickness less than 0.040 inch, said panel being bent to form upper and lower first flange portions integrally connected by a web portion disposed generally perpendicular to said flange portions, said first flange portions projecting in opposite directions from said web portion and providing said beam with a generally Z-shaped cross-sectional configuration to facilitate stacking a plurality of said beams in overlying nested relation, said web portion of said panel having a plurality of parallel spaced and longitudinally extending integrally formed stiffening ribs, upper and lower sheet metal second flange portions disposed adjacent and integrally connected to the corresponding said upper and lower first flange portions, means including a plurality of longitudinally spaced strut members extending between said upper and lower flange portions, said strut members being rigidly connected to said second flange portions, and at least one of said upper flange portions and at least one of said lower flange portions having a longitudinally extending and integrally formed stiffening rib.

23. An improved elongated beam adapted for use in constructing a metal building and having a substantially high strength/weight ratio, said beam comprising a sheet metal panel having a thickness less than 0.040 inch, said panel being bent to form upper and lower first flange portions integrally connected by a web portion disposed generally perpendicular to said flange portions, said web portion of said panel having a plurality of parallel spaced and longitudinally extending integrally formed stiffening ribs, upper and lower sheet metal second flange portions disposed adjacent the corresponding said upper and lower first flange portions, a plurality of longitudinally spaced strut members extending between said upper and lower flange portions, means rigidly connecting said strut members to said web portion and said second flange portions, and at least one of said upper flange portions and at least one of said lower flange portions having a longitudinally extending and integrally formed stiffening portion.

* * * * *